US006201501B1

(12) United States Patent
Arkko et al.

(10) Patent No.: US 6,201,501 B1
(45) Date of Patent: Mar. 13, 2001

(54) ANTENNA CONFIGURATION FOR A MOBILE STATION

(75) Inventors: Aimo Arkko, Salo; Antero Lehtola, Turku; Ilkka Pankinaho, Paimio, all of (FI)

(73) Assignee: Nokia Mobile Phones Limited, Espoo (FI)

( * ) Notice: Subject to any disclaimer, the term of this patent is extended or adjusted under 35 U.S.C. 154(b) by 0 days.

(21) Appl. No.: 09/321,861

(22) Filed: May 28, 1999

(51) Int. Cl.[7] ..... H01Q 1/24

(52) U.S. Cl. ..... 343/702; 343/700 MS; 455/90

(58) Field of Search ..... 343/702, 700 MS, 343/846; 455/90; H01Q 1/24, 1/38

(56) References Cited

U.S. PATENT DOCUMENTS 5,410,323 * 4/1995 Kuroda ..... 343/700 MS
5,710,987 * 1/1998 Paulick ..... 455/90
6,025,802 * 2/2000 Eggleston et al. ..... 343/702

OTHER PUBLICATIONS

Huang, Chih–Yu and Wu, Jian–Yi, *Compact Microstrip Antenna Loaded with Very High Permittivity Superstrate*, Feb. 1998, pp. 680–683, IEEE, 1998.

* cited by examiner

*Primary Examiner*—Hoanganh Le
(74) *Attorney, Agent, or Firm*—Robert C. Rolnik; Brian T. Rivers

(57) ABSTRACT

An antenna configuration for a mobile communication device. The antenna configuration includes at least a first antenna configured so that the first antenna may be mounted near or between a speaker and a earpiece of a mobile station. In an embodiment of the invention, the first antenna comprises a substantially flat conductor including at least one hole for passing sound from the speaker to the earpiece of the mobile station. The first antenna is configured to receive GPS signals. A second antenna is implemented on the mobile station to transmit and receive cellular transmissions.

13 Claims, 5 Drawing Sheets

ANTENNA CONFIGURATION FOR A MOBILE STATION

FIELD OF THE INVENTION

This invention relates generally to antennas and, more particularly, to compact, lightweight antennas for mobile communications devices.

BACKGROUND OF THE INVENTION

As mobile telephone technology has advanced, the phone developers have concentrated on making the phone smaller so that more volume and weight could be set aside for battery storage, while keeping the overall form-factor of the phone to be pocket-sized. With the advent of new long-life battery storage technologies and low power digital modulation, the phone has been reduced to a size and battery life that is more than adequate in both departments. Now that these problems are effectively solved, an interest to adding new features to the phone beyond ordinary telecommunications has developed. Among these features is the accurate locating technology afforded by GPS receivers.

Adding a GPS receiver to a mobile phone permits dual use of many of the phone's current parts: embedded CPU, DSP, battery, user interface. Unfortunately, cellular downlink signals are different enough from GPS downlink that an entirely different antenna and filtering arrangement may be needed. For example, GPS downlink signals are typically circularly polarized, whereas cellular signals are not. Moreover, since dual antennas are needed, each antenna must be oriented so that while the mobile phone is positioned for each specialized use, as few phone parts and external obstacles are interposed between the external radio source and the phone antenna.

Since a mobile station such as a mobile phone must be highly miniaturized in order to provide its current functionality, designers adding new features must use as little real estate on the main circuit board as possible. Current generation circular polarized patch antennas, as described, for example, in the paper, "Compact Microstrip Antenna Loaded with Very High Permittivity Superstrate", Chih-Yu Huang and Jian-Yi Wu, IEEE Antennas and Propagation Society International Symposium 1998, Jun. 21–26 1998, Atlanta Ga., may occupy as little as a square 20 mm on a side. This type of antenna, and others that lack holes are continuous conductor type antennas. Because GPS depends on line-of-sight (LOS) operation between the satellite(s) and the receiver, the GPS receive antenna must be on the top of the mobile station while employed for its locating function—which means for purposes of human-readable output, the mobile station's display must be situated on the same side as the antenna. Furthermore, the GPS antenna must be on the distant end, as opposed to the end that is grasped. Moreover, on that same side, the antenna competes for space with display, keyboard, microphone and speaker as principal front-side mobile phone components.

Deploying the GPS antenna on a flip or a boom causes its own problems. A flip requires extra enclosing hardware, as well as a resilient path for conductors to carry signals between the flip and the main phone. More parts thus produce higher cost, greater weight, lower reliability among other problems. The same problems apply to any other component that is deployed on a flip or boom.

OBJECTS OF THE INVENTION

It is therefore an object of this invention to provide an improved antenna for a mobile communications device that overcomes the foregoing and other problems.

Another object and advantage of this invention is to provide an auxiliary antenna for a mobile communications device that may be configured and hidden within the device while not disturbing significantly the functions of a basic cellular antenna.

It is a further object and advantage of this invention to provide an antenna that is transparent to sound so that sound devices may operate near the ground-plane of the antenna.

It is a further object and advantage of this invention to provide an antenna that can be situated between a speaker and a user's ear without changing the typical speaker location on the upper longitudinal middle of the front side of the phone.

It is a further object to provide an elliptically polarized antenna operating close to a non-polarized antenna such that both may be housed in a common enclosure.

SUMMARY OF THE INVENTION

The present invention provides a antenna that is compatible with the form of portable mobile devices. The antenna configuration includes a conducting portion that is flat and generally rectangularly shaped. The antenna maybe configured so the conducting portion of the antenna configuration may be mounted within a mobile station between a speaker and an earpiece. Slots may be implemented in each side to permit the conducting portion to operate like a microstrip antenna having dimensions much larger, but still with high levels of gain with respect to the desired frequencies. At least one hole may be implemented in the conducting portion to aid in sound transmission from the speaker to the earpiece. The implementation of a hole in the approximate center of the conducting portion has virtually no effect in the gain of the antenna since the central region for a continuous antenna having a rectangular shape (or with slots) is a voltage minimum.

In an embodiment of the invention, a mobile phone is provided a flat GPS antenna which has a hole through the central region. The hole is located just above a speaker or other input/output device, wherein the speaker is mounted on a printed circuit board (PCB), and the GPS antenna is set-off from the PCB, yet still enclosed within a case or casing of the mobile phone. The case has an earpiece which has holes located near to the GPS antenna hole. A cellular antenna is mounted below the PCB to permit reception and transmission of cellular frequencies. The GPS antenna, speaker, and cellular antenna are located on the part of the mobile phone that is the distant end, i.e. the remaining part of the mobile phone is for grasping and other handling by a person. In alternative embodiments, the cellular antenna may be any other type of antenna usually for cellular communications such as extendable, stub antennas or antennas embedded in flip portions of a mobile station.

Similar performance with a two-feed circularly polarized microstrip antenna can be achieved, while making the size of the two-feed antenna as small as the size of the single-feed arrangement. It is also quite common to generate elliptical polarization by using two feed points to excite two orthogonal modes on the patch with a 90 degrees phase difference between their excitations.

In another embodiment of the invention, the antenna generates elliptical polarization by using two blunt opposite corners of the patch. The placement of the feedpoint at the end of a slot is needed to provide the elliptical polarization. Enhanced performance occurs by putting a high permittivity superstrate over the patch as well as between the patch and the ground plane. The longest dimension is about 20 mm, which appears electrically as a half wavelength (about 9.5 cm for 1575 MHz GPS signals).

DETAILED DESCRIPTION OF THE INVENTION

Figure 1:
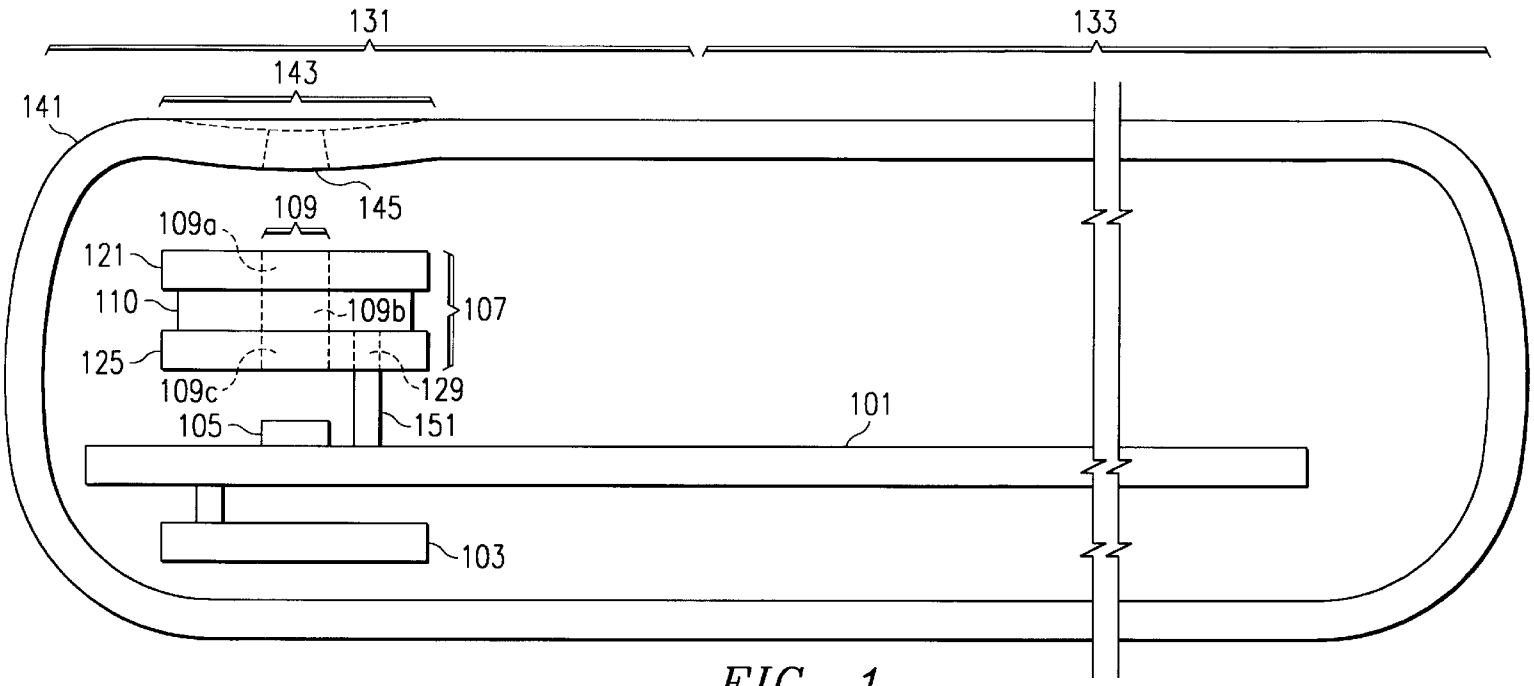
FIG. 1 is a elevation side cut away view of mobile station including a dual antenna configuration, according to an embodiment of the invention.

FIG. 1 shows a elevation view of a dual antenna configuration 100 according to an embodiment of the invention. The main supporting surface is the printed circuit board 101, which provides a ground plane on at least one side of the board. A radio transmit and receive patch antenna 103 such as U.S. patent application filed Jan. 19, 1998, appl. Ser. No. 09/005,103, is located on the back of the board, which affords the antenna fewer obstructions when an ear is placed close to the front side of the board. The front of the PCB 101 includes a sound transducer 105 which, for example, may be a speaker, 105 which is to located under a elliptically polarized GPS antenna 107. The GPS antenna 107 provides a conductor hole 109 through which sound passes. Conductor hole 109 may be square, rectangular round or any other shape. Either side of the PCB 101 can operate as a ground plane. Both antennas are mounted on the distant end 131 of the PCB 101, while the grasping end 133 may be mounted within portions of a mobile device used for handling, for example, by a hand. Surrounding the entire unit is a mobile phone exterior case 141 or casing which includes an earpiece 143 having at least one sound hole 145.

GPS ellipticaly polarized antenna 107 further includes a dielectric superstrate 121 having a superstrate hole 109*a* positioned above conductor hole 109*b* of the substantially flat conductor 110. In addition, below the conductor is the high permittivity dielectric substrate 125 and a substrate hole 109*c* as well as a feed hole 129, which provides a conduit through which feed probe 151 passes. Holes 109, 109*a*, 109*b*, 109*c*, may be square, rectangular, round or any other shape.

Both the substrate 125 and the superstrate 121 overlap all parts of conductor 110 and extend beyond the outer edges of conductor 110. The substrate 125 and the superstrate 121 may come in contact with each other.

Figure 2:
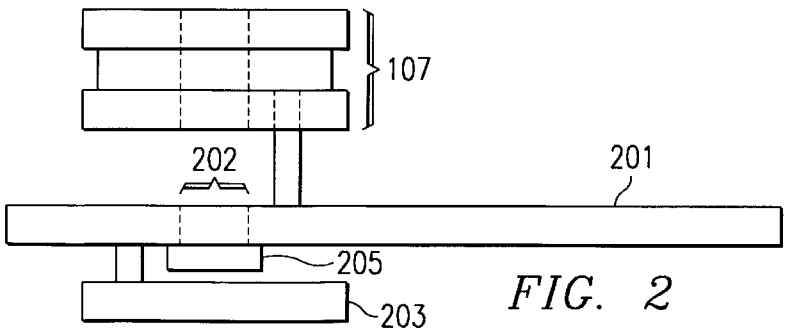
FIG. 2 is a elevation side view of a dual antenna configuration, according to an alternate embodiment of the invention.

FIG. 2 shows an alternative embodiment wherein the PCB 201 has a PCB hole 202 with a speaker 205 mounted facing the hole, but on the back side of the PCB 201. Transmit and receive antenna 203 is below the PCB 201.

Figure 3A:
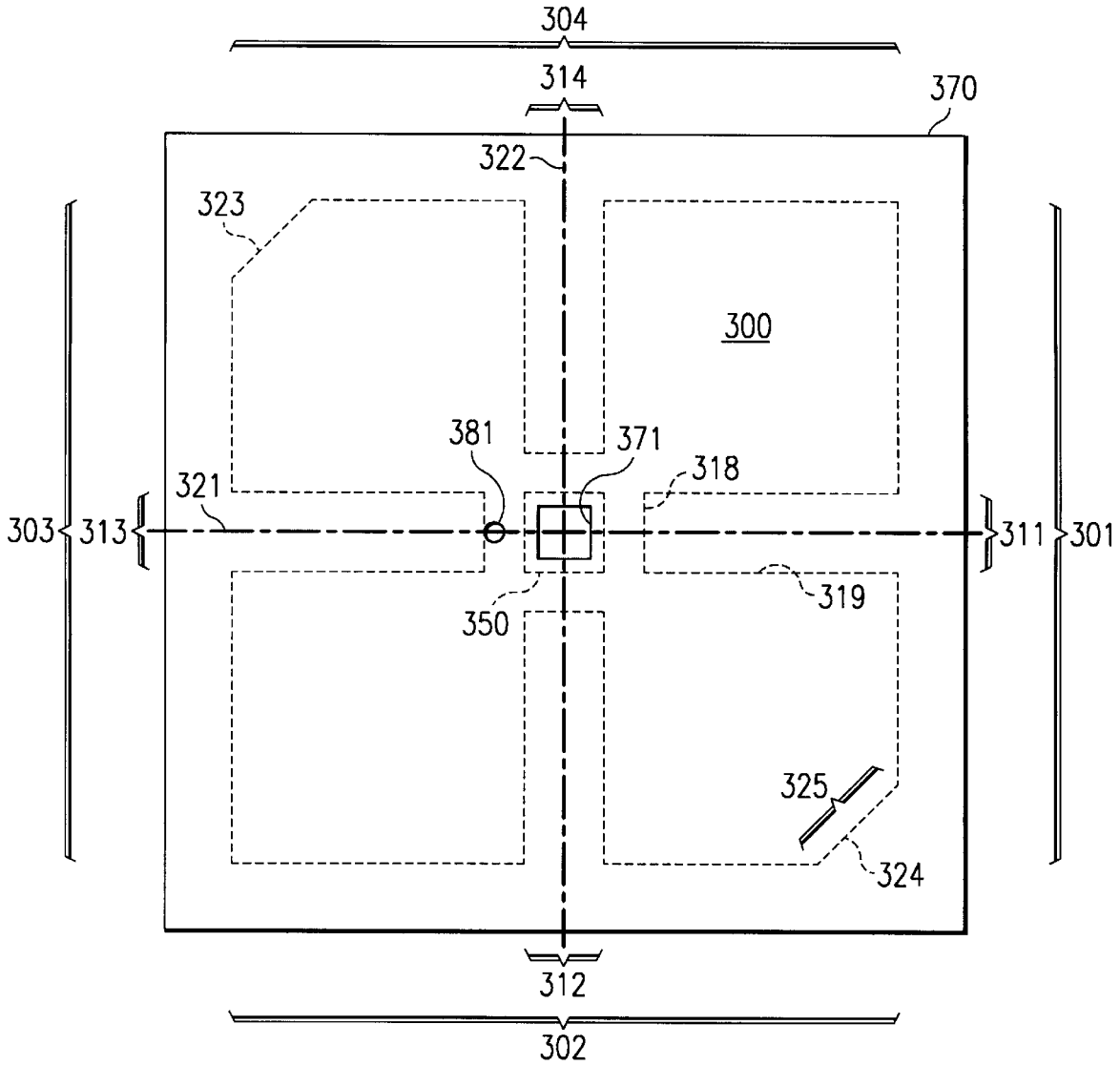
FIG. 3*a* is a top view of a GPS antenna configuration, according to an embodiment of the invention.

FIG. 3*a* shows the general configuration of a GPS antenna conductor 300 according to the invention. Antenna conductor 300 may be used in place of antenna conductor 100 of FIG. 1 and FIG. 2. All angles may be approximately 90° unless otherwise specified. The antenna conductor is generally rectangular, having sides 301, 302, 303, 304. In each side are slots 311, 312, 313, 314, having a slot width 318 and a slot length 319. Each slot may be centered on either a horizontal center line 321 or a vertical center line 322. Opposing corners have edges 323, 324, each with a blunt length 325. The edge may be at approximately 45° angle to the sides. Centered on both center lines is conductor hole 350 having a square shape. The sides of the conductor hole 350 are approximately parallel to the sides of the antenna patch. All corners may be rounded due to manufacturing tolerances by radiuses up to 5% of the shortest side next to a corner.

Figure 3B:
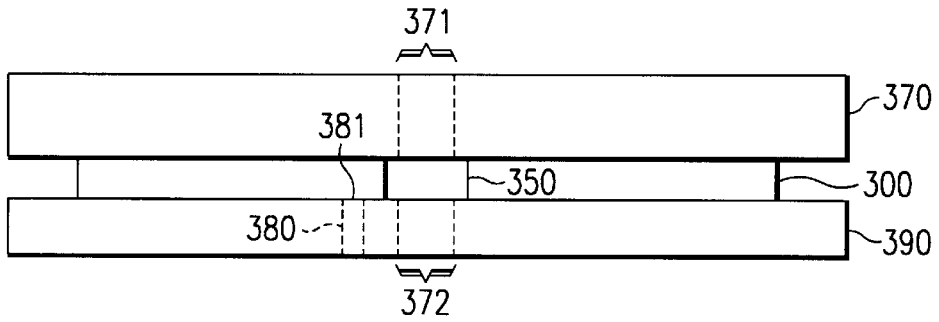
FIG. 3*b* is an elevation view of a the GPS antenna of FIG. 3*a*.

Above and below conductor 300 is a superstrate and a substrate, each having a minimal amount of overlap, which may be better seen referring to FIG. 3*b*. Superstrate perimeter 370 overlaps conductor 300. Superstrate has a hole 371 that has a area at the top of the superstrate. The hole 371 may conform to the dimensions of the conductor hole 350, or the hole 371 may be smaller in width than the conductor hole 350.

Substrate 390 has a hole 372 that has a area at the top of the substrate. The hole 372 may conform to the dimensions of the conductor hole 350, or the hole 372 may be smaller in width than the conductor hole 350. Multiple holes through the substrate 390 and superstrate 370 can substitute for a single hole, so long as all the holes line up and together allow significant sound to pass through. In addition, each of the substrate and superstrate holes must have at least one end at the main conductor hole 350.

In addition, substrate has a feed hole 380 through which a conductor or feed probe may pass. Feed hole 380 ends at feedpoint 381 on the underside of the antenna. Feedpoint 381 is centered on horizontal centerline 321, but may function just as well on the vertical centerline 322. The choice of centerlines, and location on either side of the conductor hole is not important since a mirror image of the antenna operates just the same as the opposite orientation, except that the mirror image antenna receives left-hand circular polarized signals. However, in the case where the invention must handle GPS signals, which are right-hand circular polarized, only the orientation as appears in FIG. 3 will properly receive such signals. All holes, whether in the substrate or the superstrate pass in an orthogonal direction in relation to the PCB. A GPS signal carrying conductor attaches by means known in the art to couple the antenna conductor via the feedpoint 381 to filter or amplifier circuitry located on or below the ground plane.

Figure 4A:
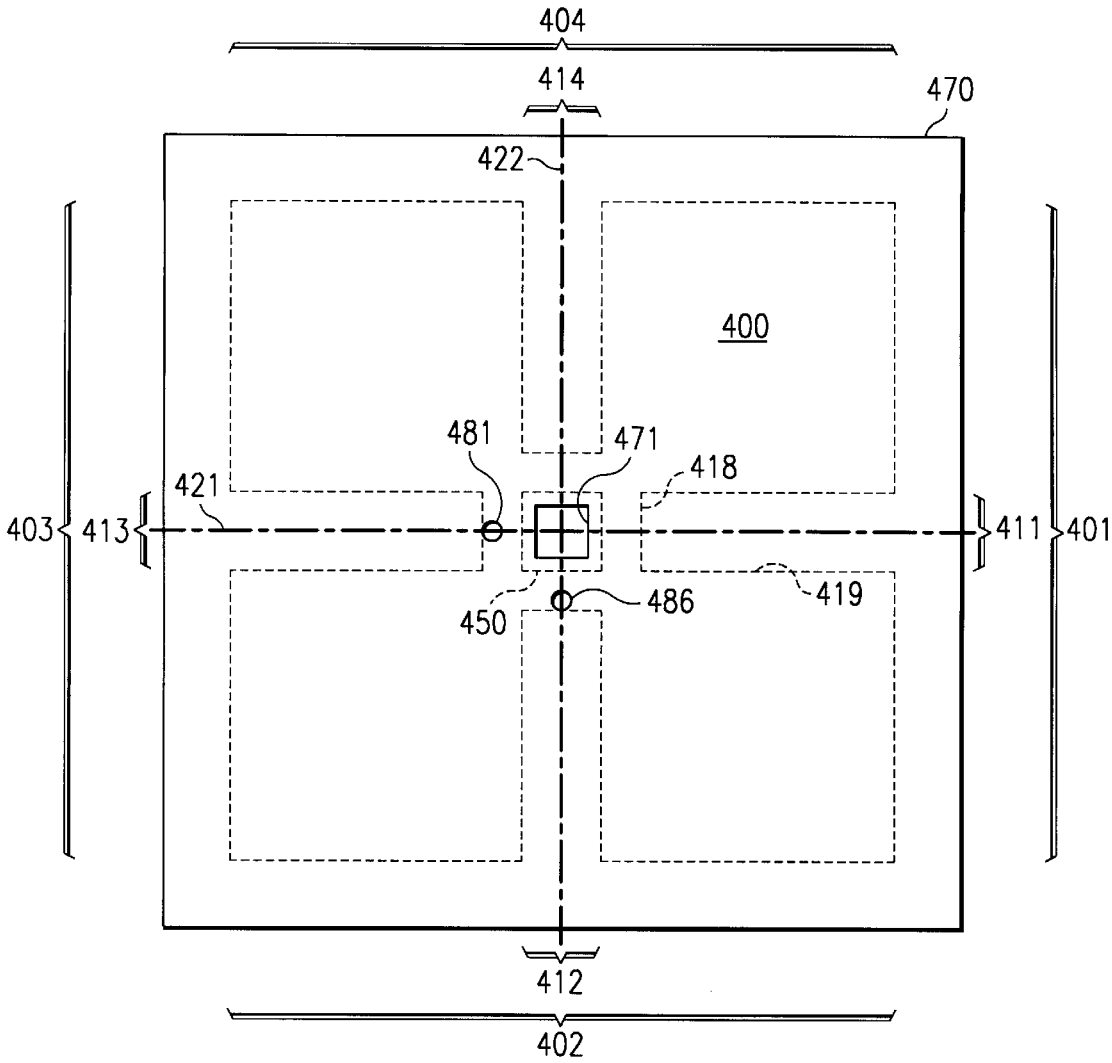
FIG. 4*a* is a perspective view of a GPS antenna configuration according to an alternate embodiment of the invention.

FIG. 4*a* shows the general configuration of a GPS antenna conductor 400 according to the invention. Antenna conductor 400 may be used in place of antenna conductor 100 of FIG. 1 and FIG. 2. All angles may be approximately 90° unless otherwise specified. The antenna conductor is generally rectangular, having sides 401, 402, 403, 404. In each side are slots 411, 412, 413, 414, having a slot width 418 and a slot length 419. Each slot may be centered on either a horizontal center line 421 or a vertical center line 422. Centered on both center lines is conductor hole 450 having a square shape. The sides of the conductor hole 450 are approximately parallel to the sides of the antenna patch. All corners may be rounded due to manufacturing.

Figure 4B:
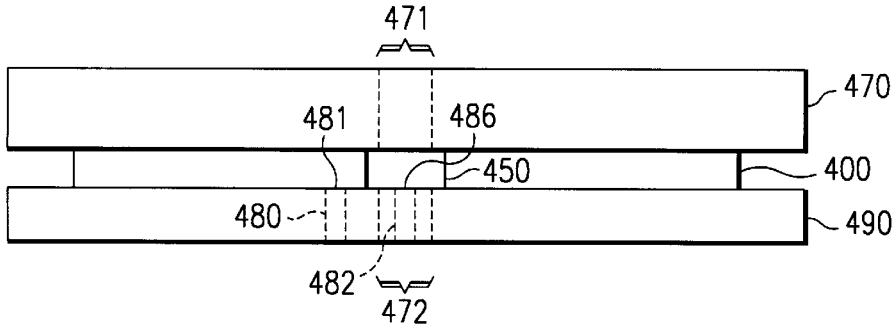
FIG. 4*b* is an elevation side view of the antenna configuration of FIG. 4*a*.

Above and below conductor 400 is a superstrate and a substrate, each having a minimal amount of overlap, which may be better seen referring to FIG. 4*b*. Superstrate perimeter 470 overlaps conductor 400. Superstrate has a hole 471 that has a area at the top of the superstrate. The hole 471 may conform to the dimensions of the conducto r hole 450, or the hole 471 may be smaller in width than the conductor hole 450.

Substrate 490 has a hole 472 that has a area at the top of the substrate. The hole 472 may conform to the dimensions of the conductor hole 450, or the hole 472 may be smaller in width than the conductor hole 450. Multiple holes through the substrate 490 and superstrate 470 can substitute for a single hole, so long as all the holes line up and together allow significant sound to pass through. In addition, each of the substrate and superstrate holes must have at least one end at the main conductor hole 450.

In addition, substrate has a first feed hole 480 through which a first conductor or feed probe may pass. First feed hole 480 ends at feedpoint 481 on the underside of the antenna. Feedpoint 481 is centered on horizontal centerline 421. All holes, whether in the substrate or the superstrate pass in an orthogonal direction in relation to the PCB. A GPS signal carrying conductor attaches by means known in the art to couple the antenna conductor via the feedpoint 481 to filter or amplifier circuitry located on or below the ground plane.

In addition, substrate has a second feed hole 485 through which a second conductor or feed probe may pass. Second feed hole 485 ends at feedpoint 486 on the underside of the antenna. Feedpoint 486 is centered on vertical centerline 422. All holes, whether in the substrate or the superstrate pass in an orthogonal direction in relation to the PCB. A GPS signal carrying conductor attaches by means known in the art to couple the second antenna conductor via the feedpoint 486 to filter or amplifier circuitry located on or below the ground plane.

Figure 5A:
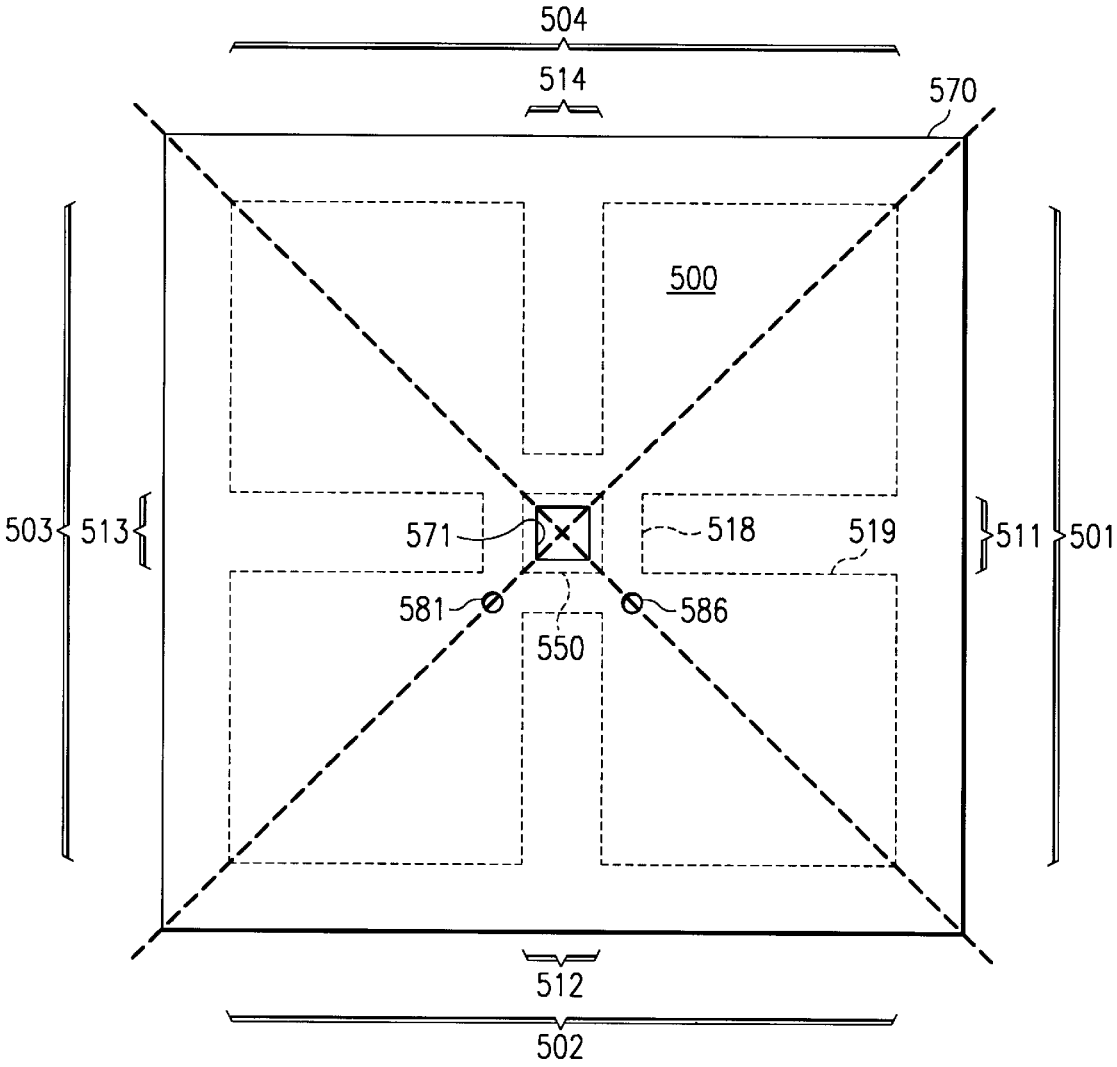
FIG. 5*a* is a perspective view of GPS antenna configuration according to an alternate embodiment of the invention.

FIG. 5*a* shows the general configuration of a GPS antenna conductor 500 according to the invention. Antenna conductor 500 may be used in place of antenna conductor 100 of FIG. 1 and FIG. 2. All angles may be approximately 90° unless otherwise specified. The antenna conductor is generally rectangular, having sides 501, 502, 503, 504. In each side are slots 511, 512, 513, 514, having a slot width 518 and a slot length 519. Each slot may be centered on either a horizontal center line 521 or a vertical center line 522. Centered on both center lines is conductor hole 550 having a square shape. The sides of the conductor hole 550 are approximately parallel to the sides of the antenna patch. All corners may be rounded due to manufacturing.

Figure 5B:
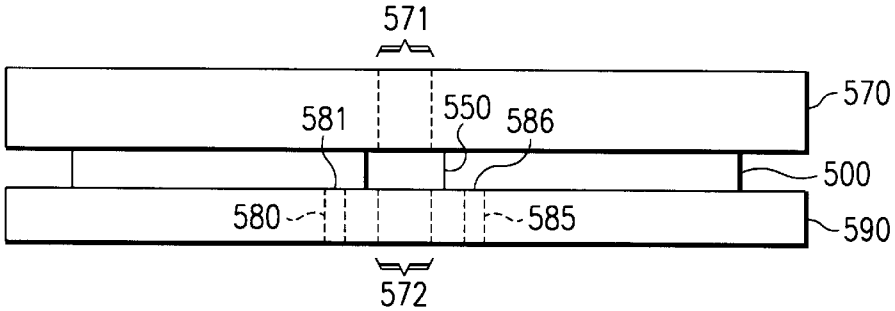
FIG. 5*b* is an elevation side view of the antenna configuration of FIG. 5*a*.

Above and below conductor 500 is a superstrate and a substrate, each having a minimal amount of overlap, which may be better seen referring to FIG. 5*b*. Superstrate perimeter 570 overlaps conductor 500. Superstrate has a hole 571 that has a area at the top of the superstrate. The hole 571 may conform to the dimensions of the conductor hole 550, or the hole 571 may be smaller in width than the conductor hole 550.

Substrate 590 has a hole 572 that has a area at the top of the substrate. The hole 572 may conform to the dimensions of the conductor hole 550, or the hole 572 may be smaller in width than the conductor hole 550. Multiple holes through the substrate 590 and superstrate 570 can substitute for a single hole, so long as all the holes line up and together allow significant sound to pass through. In addition, each of the substrate and superstrate holes must have at least one end at the main conductor hole 550.

In addition, substrate has a first feed hole 580 through which a first conductor or feed probe may pass. First feed hole 580 ends at feedpoint 581 on the underside of the antenna. Feedpoint 581 is centered on diagonal centerline 521. All holes, whether in the substrate or the superstrate pass in an orthogonal direction in relation to the PCB. A GPS signal carrying conductor attaches by means known in the art to couple the antenna conductor via the feedpoint 581 to filter or amplifier circuitry located on or below the ground plane.

In addition, substrate has a second feed hole 585 through which a second conductor or feed probe may pass. Second feed hole 585 ends at feedpoint 586 on the underside of the antenna. Feedpoint 586 is centered on diagonal centerline 522. All holes, whether in the substrate or the superstrate pass in an orthogonal direction in relation to the PCB. A GPS signal carrying conductor attaches by means known in the art to couple the second antenna conductor via the feedpoint 586 to filter or amplifier circuitry located on or below the ground plane.

Figure 6A:
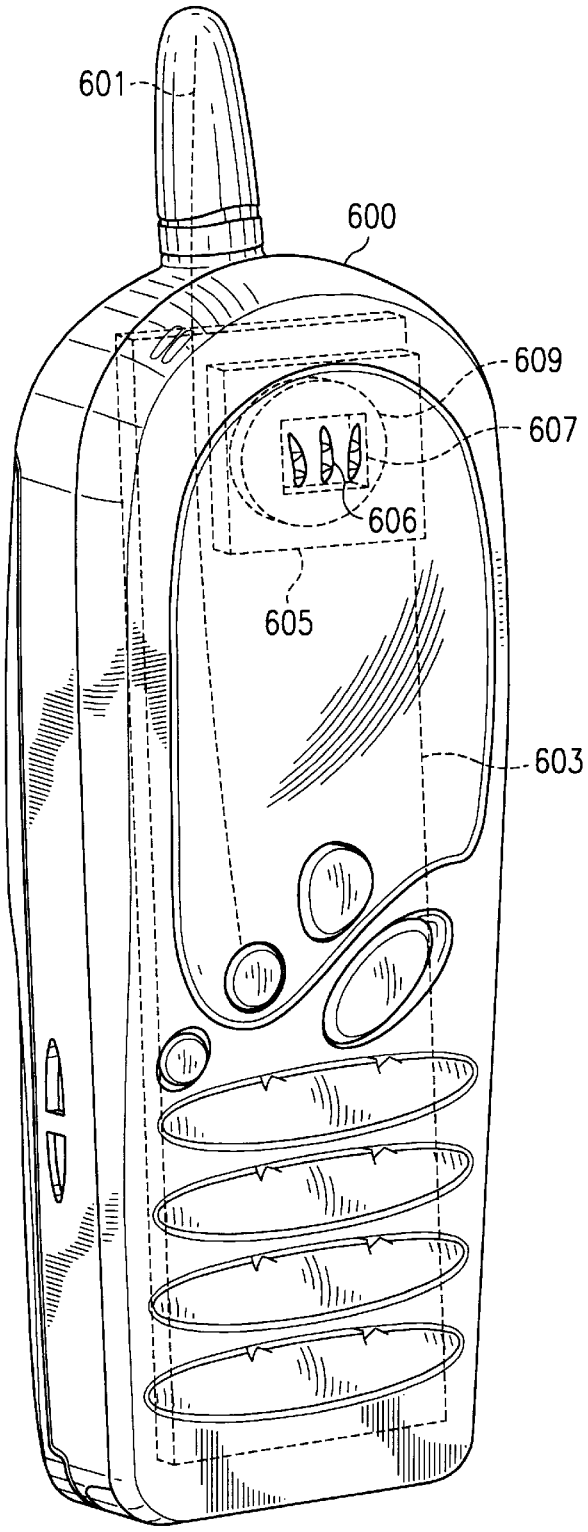
FIG. 6*a* is a perspective view of a mobile phone including an antenna configuration according to an alternate embodiment of the invention.

FIG. 6*a* is a perspective view of an alternate embodiment of the invention which includes a stub antenna 601, case 600, PCB 603 and GPS antenna 605. A case hole 606 is disposed above the GPS antenna hole 607. Below the GPS antenna hole 607 is a speaker 609. Stub antenna 601 is situated below the PCB 603. The stub antenna 601 is the cellular transmit and receive antenna.

Figure 6B:
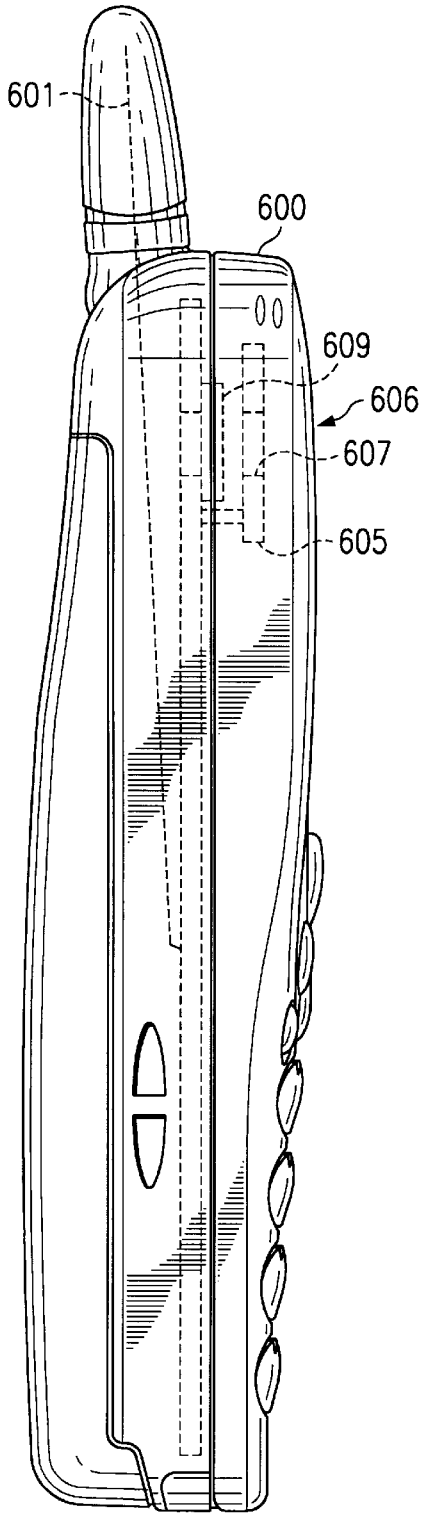
FIG. 6*b* is an elevation side view of the antenna configuration of FIG. 6*a*.

FIG. 6*b* is a perspective view of an alternate embodiment of the invention which includes a stub antenna 601, case 600, PCB 603 and GPS antenna 605. A case hole 606 is disposed above the GPS antenna hole 607. Below the GPS antenna hole 607 is a speaker 609. Stub antenna 601 is situated below the PCB 603. The stub antenna 601 is the cellular transmit and receive antenna.

Operation of the mobile according to the embodiment of the invention is accomplished in one of two modes. For ordinary voice functions of receiving or replaying voice through a speaker, the mobile is operated with the hole of the patch antenna close to the ear of a user. The use of an accessory such as a bud speaker on an extended wire is also an option, wherein the phone may operate in any orientation. Operation of the mobile for purposes of receiving a GPS signal involves holding the mobile in a horizontal, front-up position. In this position, a user may manipulate a keyboard on a mobile phone or any other input device necessary to control the GPS receiver by handling the grasping end of the mobile phone.

Although the invention has been described in the context of particular embodiments, it will be realized that a number of modifications to these teachings may occur to one skilled in the art. For example, all manner of fixed, extendable, patch or microstrip antennas could be used for the transmit and receive antenna. Similarly, many elliptically polarized antennas may be substituted for the rectangularly shaped antenna. Thus, while the invention has been particularly shown and described with respect to specific embodiments thereof, it will be understood by those skilled in the art that changes in form and configuration may be made therein without departing from the scope and spirit of the invention.

What is claimed is:

1. An antenna configuration for use with a mobile station having a circuit board and a case having at least one sound hole, said antenna configuration comprising:

a speaker mounted on the circuit board; and a patch antenna mounted internal to the case between said speaker and the at least one sound hole, the patch antenna having a conductor hole, said patch antenna disposed adjacent to said speaker wherein sound from said speaker passes through said conductor hole to the at least one sound hole.

2. The antenna configuration of claim 1, wherein said patch antenna has a rectangular shape and said conductor hole is located centrally on said patch antenna.

3. The antenna configuration of claim 2, wherein said patch antenna is substantially parallel to the circuit board.

4. The antenna configuration of claim 1, wherein said antenna configuration further comprises a superstrate having a superstrate hole, and a substrate having a substrate hole, wherein said patch antenna is mounted between said superstrate and said substrate and wherein sound from said speaker passes through said substrate, conductor, and superstrate holes to said at least one sound hole.

5. The antenna of claim 4, wherein said patch antenna has at least a slot in each side, each slot having a slot end.

6. The antenna of claim 4, wherein said patch antenna is substantially parallel to the circuit board.

7. An antenna configuration for use in a mobile station having a case, a speaker and an earpiece formed within the case, the antenna configuration comprising:

an antenna disposed internally within the case, said antenna comprising a conductor portion including at least one hole, wherein said conductor portion is disposed between the speaker and the earpiece, and wherein sound from the speaker passes through said at least one hole of said conductor portion to the earpiece.

8. The antenna configuration of claim 7, wherein said conductor portion is disposed substantially perpendicular to the direction of sound travel, between said speaker and said earpiece.

9. The antenna configuration of claim 7, wherein said at least one hole comprises a hole located substantially centrally in said conduct or portion.

10. The antenna configuration of claim 7, wherein said conductor portion comprises a first antenna, wherein the mobile station comprises a mobile handset operable as a cellular telephone and as a GPS locating device, wherein said first antenna is configured to receive GPS signals, and wherein said antenna configuration further comprises a second antenna for transmitting and receiving cellular telephone signals.

11. The antenna configuration of claim 10, wherein said second antenna is external to the mobile handset when operable for transmitting and receiving cellular telephone signals.

12. A mobile handset operable as a cellular transceiving device and as a GPS locating device, said mobile handset comprising:

a casing having a first at least one hole;

a speaker mounted internal to said casing, said speaker for projecting sound waves to said first at least one hole;

a first antenna mounted internal to said casing and for receiving GPS signals, said first antenna having a substantially flat conductor portion including a second at least one hole, said conductor portion disposed substantially perpendicular to the direction of sound travel between said speaker and said first at least one hole, wherein sound from said speaker passes through said second at least on hole to said first at least one hole; and a second antenna mounted in said casing, said antenna for transmitting and receiving cellular transmissions.

13. The mobile handset of claim 12, wherein said first antenna further comprises a substrate and a superstrate, and wherein said conductor portion is mounted between said substrate and superstrate.

* * * * *